US009153216B2

(12) United States Patent
Tétreault

(10) Patent No.: US 9,153,216 B2
(45) Date of Patent: Oct. 6, 2015

(54) STREAMLINED ROTARY VALVE FOR MUSICAL WIND INSTRUMENTS

(71) Applicant: Simon Olivier Tétreault, Saint-Liguori (CA)

(72) Inventor: Simon Olivier Tétreault, Saint-Liguori (CA)

( * ) Notice: Subject to any disclaimer, the term of this patent is extended or adjusted under 35 U.S.C. 154(b) by 197 days.

(21) Appl. No.: 14/025,838

(22) Filed: Sep. 13, 2013

(65) Prior Publication Data

US 2015/0075353 A1 Mar. 19, 2015

(51) Int. Cl.
*G10D 9/04* (2006.01)
*G10D 7/10* (2006.01)

(52) U.S. Cl.
CPC ... *G10D 9/04* (2013.01); *G10D 7/10* (2013.01)

(58) Field of Classification Search
USPC ..... 84/390
See application file for complete search history.

(56) References Cited

U.S. PATENT DOCUMENTS

| | | | | | |
|---|---|---|---|---|---|
| 4,112,806 | A * | 9/1978 | Thayer | ..... | 84/390 |
| 4,213,371 | A * | 7/1980 | Thayer | ..... | 84/390 |
| 5,361,668 | A * | 11/1994 | Andersen et al. | ..... | 84/392 |
| 5,396,825 | A * | 3/1995 | Kirts | ..... | 84/390 |
| 5,798,471 | A * | 8/1998 | Miller | ..... | 84/390 |
| 5,965,833 | A * | 10/1999 | Lindberg | ..... | 84/390 |
| 7,112,735 | B2 * | 9/2006 | Shire | ..... | 84/395 |

* cited by examiner

*Primary Examiner* — Christopher Uhlir
(74) *Attorney, Agent, or Firm* — Leong C. Lei

(57) ABSTRACT

A streamlined rotary valve includes a main body with a first, a second, and a third tube. A first casing member includes a first opening, a first and a second air inlet opening, which are in communication with a first accommodation space. The first air inlet opening is connected to an end of the first tube. A manual actuator includes a pressing section, which when pressed, an end of the third tube is set in communication with the first air inlet opening; an opposite end of the third tube in communication with the second air outlet opening; an end of the second tube in communication with the second air inlet opening; and an opposite end of the second tube in communication with the first air outlet opening, thus generates different sound effects. With 72 degrees angle of rotation and adjustable stop elements, the present invention improves speed response and accuracy.

13 Claims, 14 Drawing Sheets

STREAMLINED ROTARY VALVE FOR MUSICAL WIND INSTRUMENTS

TECHNICAL FIELD OF THE INVENTION

The present invention generally relates to a rotary fluid valve, and more particularly to a streamlined rotary air valve for musical instruments.

DESCRIPTION OF THE PRIOR ART

One recognized method of changing tones in a musical wind instrument, particularly a brass instrument, is to change the length of the path an air column travels through the instrument. One way to achieve this is to provide the instrument with alternate loops of tubing of different length connected by one or more valves. As a valve is switched between alternate set positions, the air column is diverted through alternative desired combinations of loops resulting in different path lengths and thus different tones.

Rotary valves have long been used for musical instruments and are highly regarded for their quick action and relative simplicity of structure. Rotary valves have made improvement in reducing overtones in the sound of the instrument caused by sound waves partially reflecting off the inside walls of air passages as the air column travels through bends. Such partial reflection reduces the energy of the fundamental sound wave and produces undesirable overtones. Current rotary valves such as the Thayer valve, Hagmann valve, Shires Truebore, Miller Valve, Hulot, Lindberg valve, etc. . . . , reduce overtones by minimizing bends of the air passages through the valves and by providing air passage cross sections that are as smooth as possible at every point through the valve, thus minimizing any air passage characteristics that will create turbulence in an air column traveling through the passage.

Losing alignment precision after a period of time is a common problem with the traditional rotary valves and its recent improvements.

The constant need of lubrication is also a big issue. The traditional rotary valve and its modified versions become troublesome for the players when they are not sufficiently lubricated—the valve action becomes slower, noisy and sometimes stiff which makes the brass players very uncomfortable during their performances.

Constant lubrication of the valve and joint mechanism causes unpleasant leakage on the player's hand and neck, and stains their skin or clothes. Also the leakage inside the instrument could be a health hazard for the musicians when inhaled into their lungs.

Some makers have considerably improved the valves by avoiding altering the original design of the instrument which preserves the natural sound characteristics, however they compromised on design that result in a discomfort for the players having parts of the valve casing and/or tubing is pressing against their cheek and neck.

A rotary valve should keep the natural characteristics of the music instrument. Other than controllability and tone quality, a rotary valve must have a fast, quiet and precise action; easy maintenance by the users; the precision and respond of the moving parts should not become loose over a period of time; it should not have any leakage of any lubricant to interfere with the player during the performances.

In view of the above described, the streamlined rotary valve, which is created base on the inventor's years of study and research, aims to overcome such drawbacks. The present invention would certainly be an important advance in the art.

SUMMARY OF THE INVENTION

To achieve the above object, the present invention provides a streamlined rotary valve, which comprises: a main body, which comprises a first tube, a second tube, and a third tube. The main body has a top on which a projecting axle is formed. A first casing member comprises a first accommodation space, a first opening, a first air inlet opening, a second air inlet opening, a first fixing section, and a first pivot shaft, which are respectively provided on the first casing member, the first pivot shaft being coupled to the main body. The first opening, the first air inlet opening, and the second air inlet opening are in communication with the first accommodation space. The first air inlet opening is connected to an end of the first tube. A second casing member comprises a second accommodation space, a second opening, a first air outlet opening, a second air outlet opening, and a shaft hole, which are in communication with the second accommodation space. The first opening corresponds to and is coupled to the second opening. An opposite end of the first tube connected to the first air outlet opening. The projecting axle is received through the shaft hole. A manual actuator comprises a pressing section, a second fixing section, and a driving section. The second fixing section is rotatably mounted to the first fixing section. The driving section is coupled to the projecting axle. When the pressing section is pressed down by an external force, the driving section drives the projecting axle to rotate to have an end of the third tube communicating with the first air inlet opening, an opposite end of the third tube communicating with the second air outlet opening, an end of the second tube communicating with the second air inlet opening, and an opposite end of the second tube communicating with the first air outlet opening to generate a different sound effect.

The goal of the present invention is to produce a valve that does not change the nature of the instrument; a valve that sustains the normal air stream thus preserves the natural characteristics of balance of the instrument.

The streamlined rotary valve has numerous unique features; it keeps the air path in a perfect loop around the instrument without any compromise; the straight neck windpipe which is positioned eccentrically to the valve rotation axis provides perfect tonal quality and it grants comfort to the player's cheek and neck; furthermore, the streamlined valve action is simplified and with only 72 degrees angle of rotation, it allows quick changes between the different air passages. The independent adjustable stop elements inside the valve casing make the valve action very quiet. In addition, the streamline rotary valve allows constant control of alignment whereas the valves on the market have stoppers that would eventually lose their shape, break apart, and even fall off. The design includes two Allen set screws outside the valve casing that players can adjust easily to perfect the alignment simply using an Allen key. Moreover, the present invention uses sealed ball bearings and driving string that require no use of lubricant. This significantly resolves the issues of inefficiency, noise and leakage. Because of its unique structure, carefully designed shape, and innovative elements of the mechanism, the streamlined valve is built to stay precise and efficient over time.

The foregoing objectives and summary provide only a brief introduction to the present invention. Other objects, features, and advantages of the present invention will become conspicuous to those skilled in the art upon reading the following detailed descriptions accompanying by the illustrations.

DETAILED DESCRIPTION OF THE PREFERRED EMBODIMENTS

Figure 1:
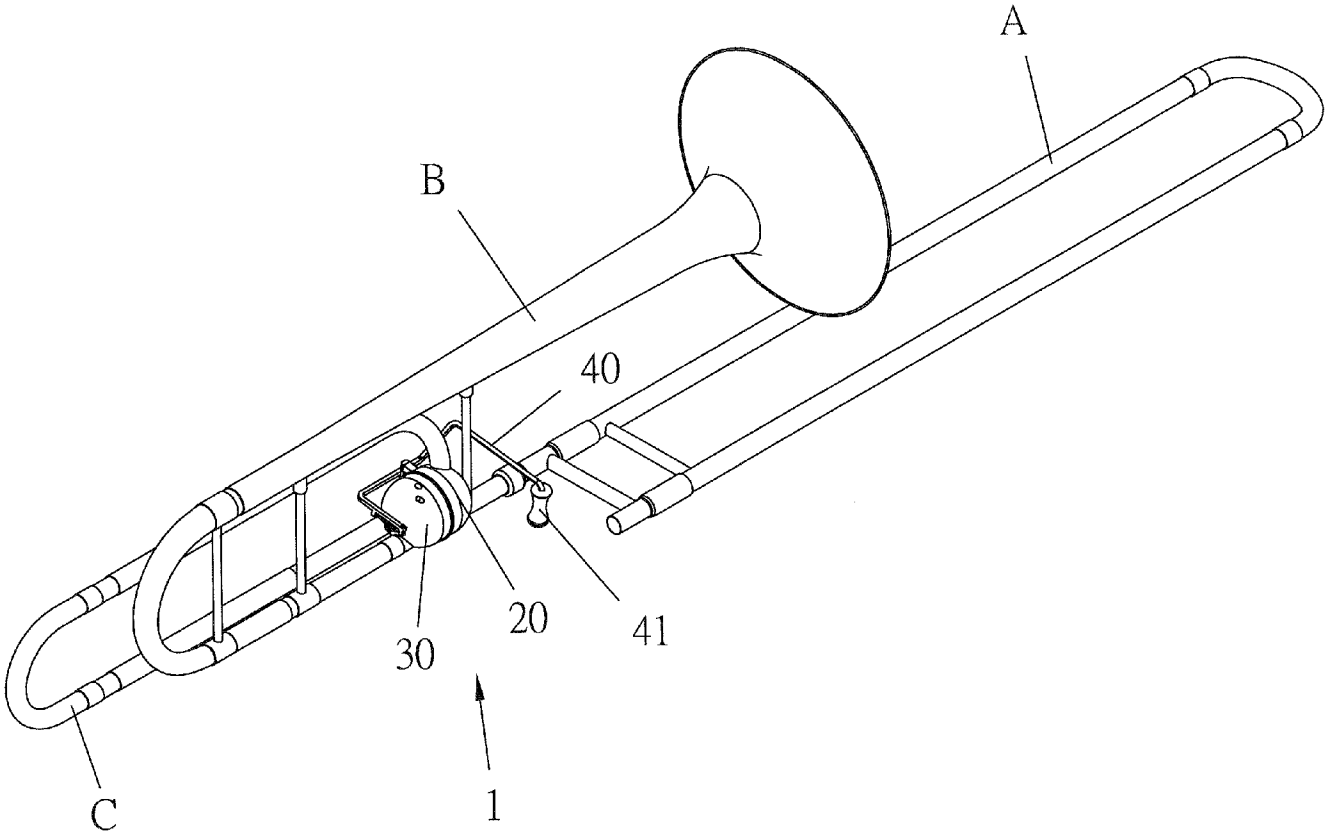
FIG. 1 is a perspective view showing a streamlined rotary valve according to the present invention mounted on a trombone.
Figure 2:
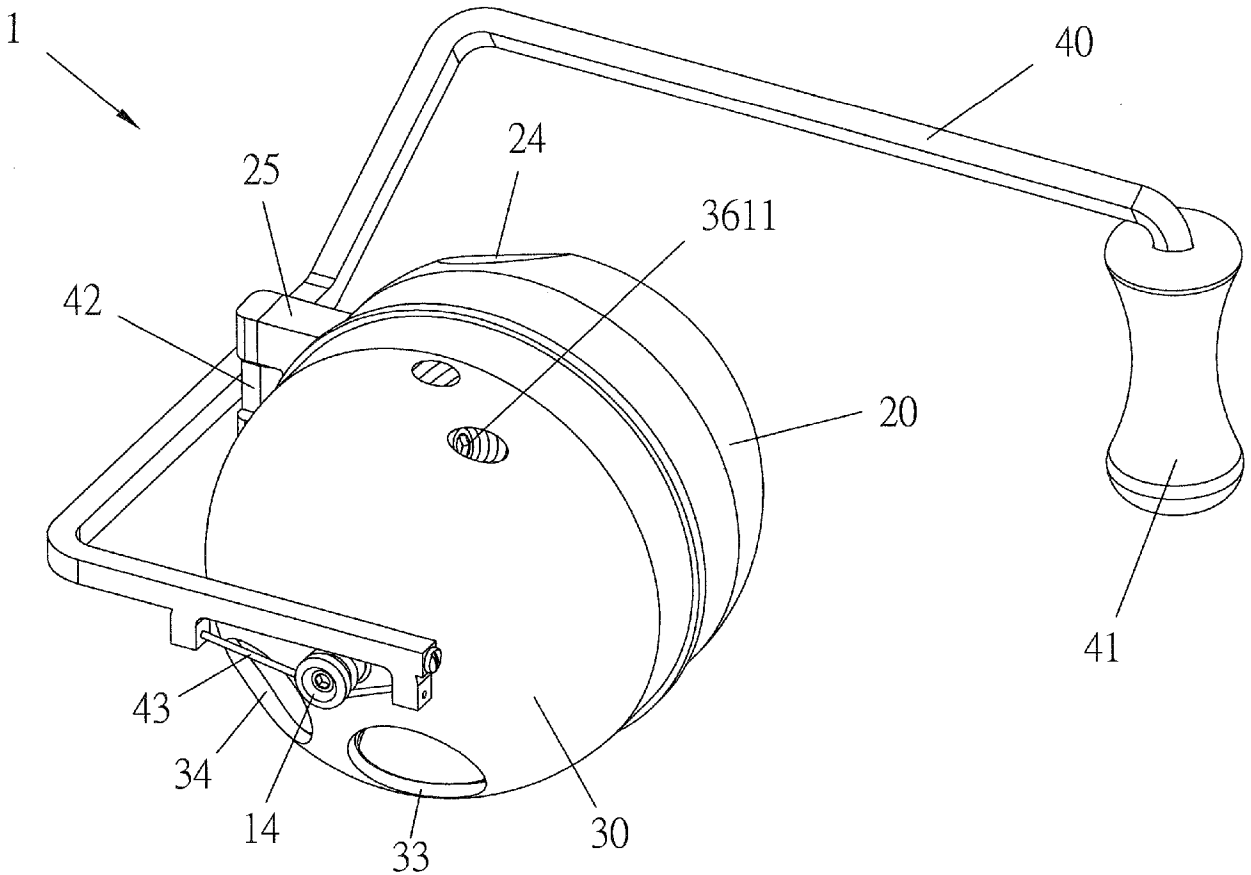
FIG. 2 is a perspective view of the streamlined rotary valve according to the present invention.
Figure 3:
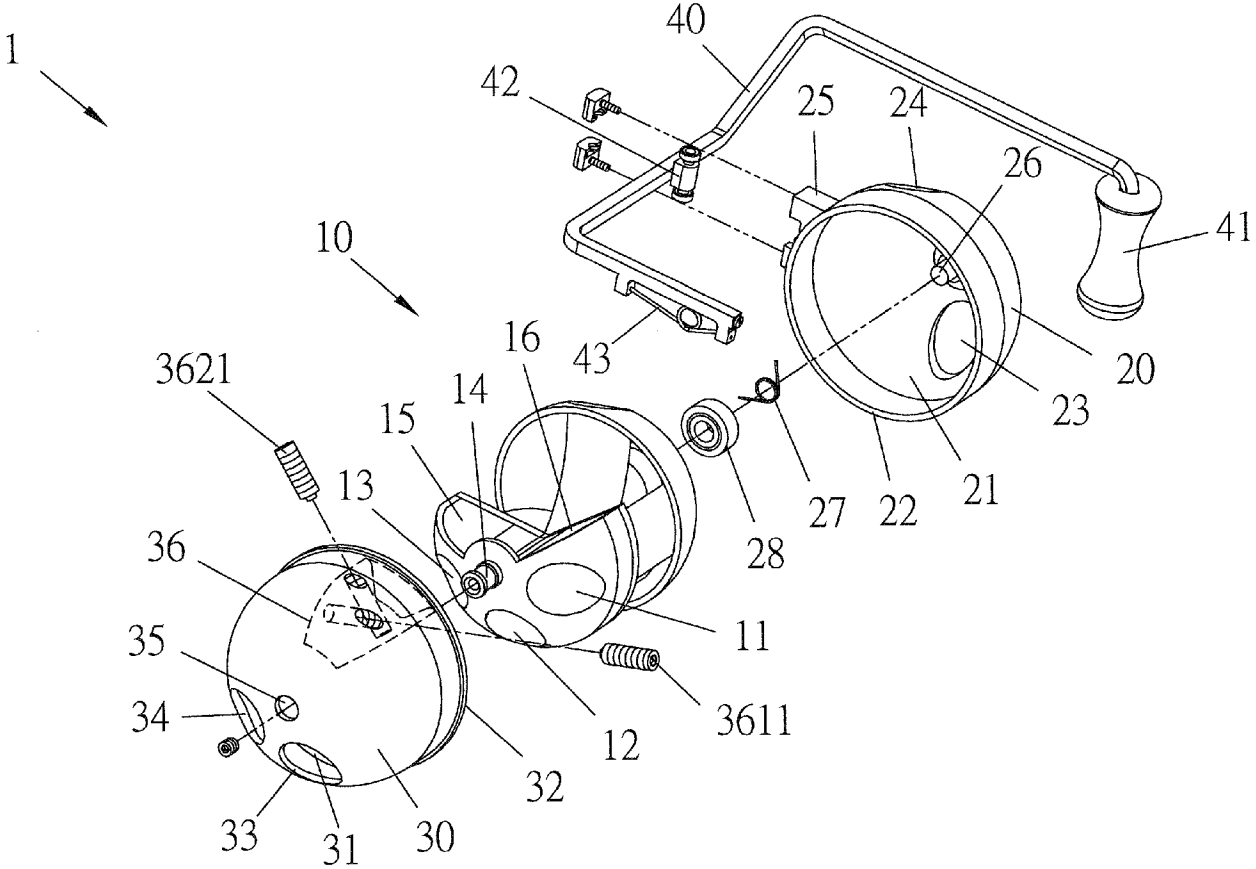
FIG. 3 is an exploded view of the streamlined rotary valve according to the present invention.
Figure 4:
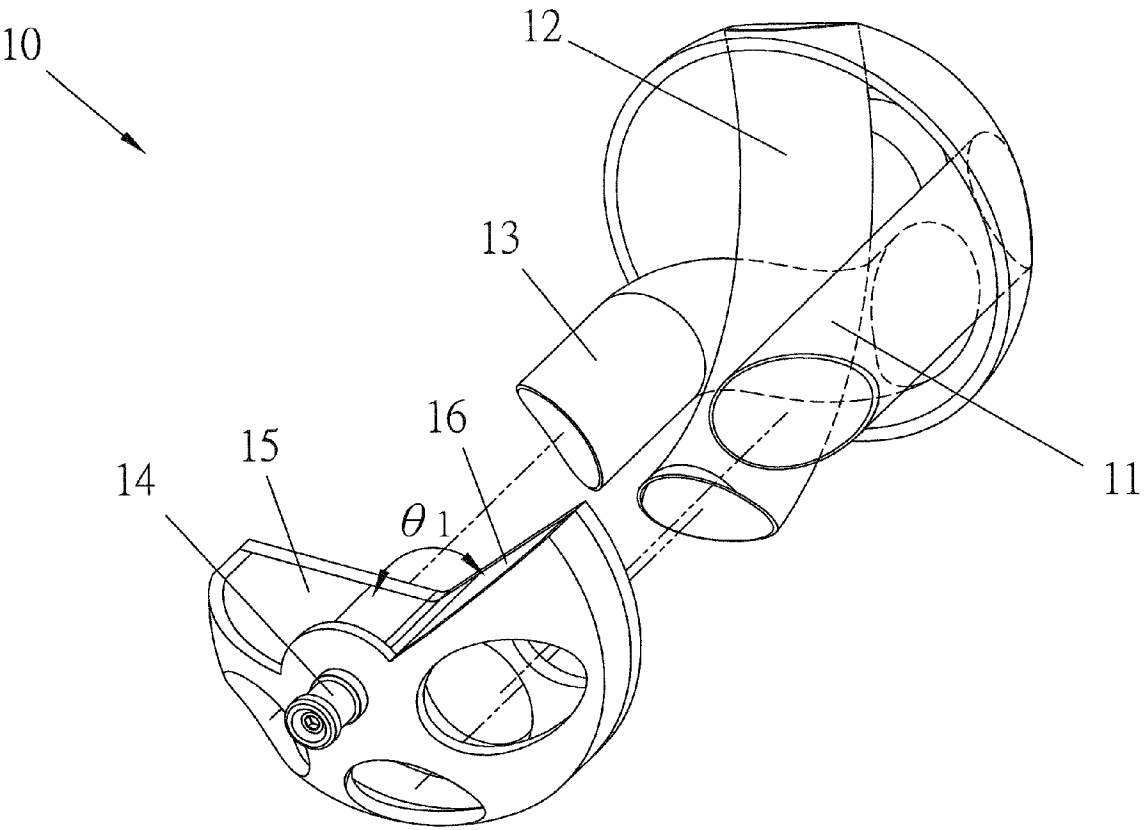
FIG. 4 is an enlarged view of a portion of FIG. 3.
Figure 5:
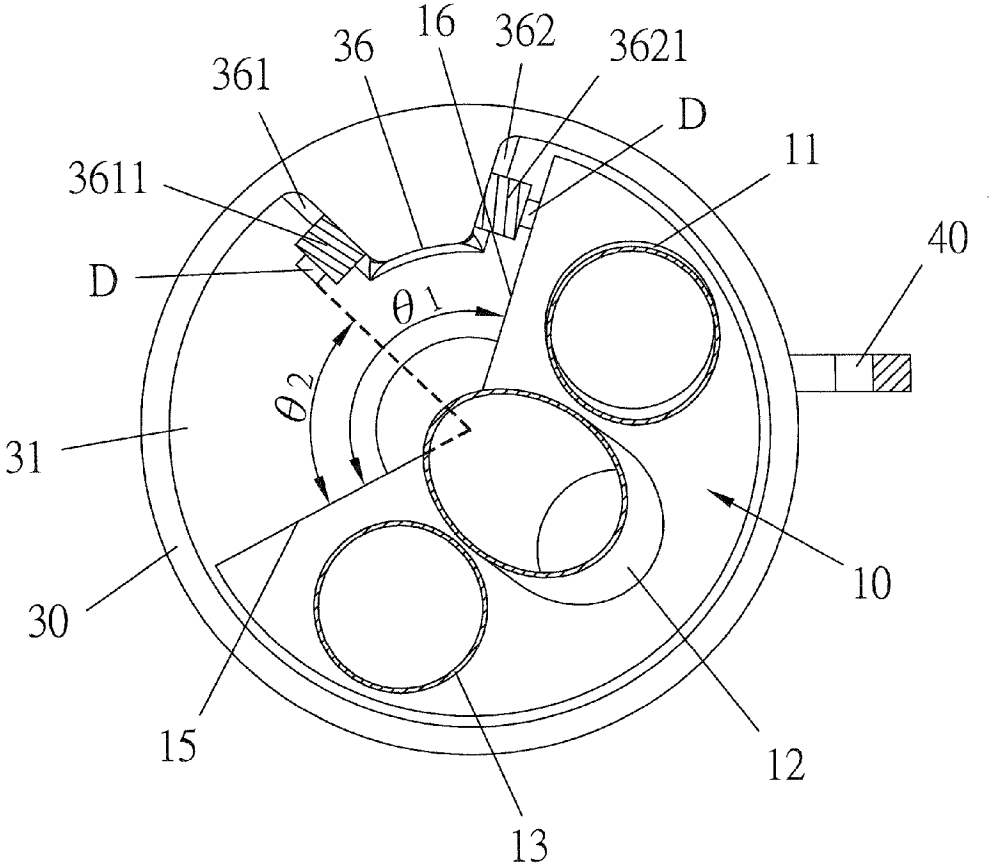
FIG. 5 is a cross-sectional view of FIG. 6 taken along a radial direction.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-4, the present invention provides a streamlined rotary valve 1, which comprises: a main body 10, a first casing member 20, a second casing member 30, and a manual actuator 40.

The main body 10 comprises a first tube 11 extending through the main body 10, a second tube 12 extending through the main body 10, and a third tube 13 extending through the main body 10. The main body 10 has a top on which a projecting axle 14 is formed.

The first tube 11 is located eccentrically to the main body's projecting axle 14 in order not to interfere with the user during the use thereof for improving comfortableness.

The main body 10 has one side on which a first stop section 15 and a second stop section 16 are formed. The first stop section 15 and the second stop section 16 define a predetermined included angle a therebetween measured about a center defined by the projecting axle 14.

The first casing member 20 comprises a first accommodation space 21, a first opening 22, a first air inlet opening 23, a second air inlet opening 24, a first fixing section 25, and a first pivot shaft 26.

The first opening 22, the first air inlet opening 23, the second air inlet opening 24, the first fixing section 25, and the first pivot shaft 26 are respectively provided at predetermined locations on the first casing member 20, whereby the first pivot shaft 26 is rotatably coupled to the main body 10 and the first opening 22, the first air inlet opening 23, and the second air inlet opening 24 are respectively in communication with the first accommodation space 21. The first air inlet opening 23 is connected to an end of the first tube 11.

The pivot shaft 26 is provided at an inside bottom of the first accommodation space 21 and the pivot shaft 26 is provided with and encompassed by an elastic element 27 and a ball bearing 28, whereby the pivot shaft 26 is rotatably coupled to a bottom of the main body 10. The first air inlet opening 23 of the first casing member 20 is connected, at the outside thereof, to a main slide unit A.

The second casing member 30 comprises a second accommodation space 31, a second opening 32, a first air outlet opening 33, a second air outlet opening 34, and a shaft hole 35.

The second accommodation space 31, the second opening 32, the first air outlet opening 33, the second air outlet opening 34, and the shaft hole 35 are respectively provided at predetermined locations on the second casing member 30 and are each in communication with the second accommodation space 31. The first opening 22 corresponds to and is coupled to the second opening 32, so as to have the first accommodation space 21 and the second accommodation space 31 jointed to and communicating with each other to accommodate the main body 10 therebetween. The first tube 11 has an end that is opposite to the end connected to the first air inlet opening 23 and is connected to the first air outlet opening 33. The projecting axle 14 is received through the shaft hole 35.

The first air outlet opening 33 of the second casing member 30 is connected, at the outside thereof, to a bell unit B. The second air inlet opening 24 of the first casing member 20 and the second air outlet opening 34 of the second casing member 30 are connected, at the outside thereof, to a tuning slide unit C.

Referring to FIGS. 3-8, the second accommodation space 31 comprises a stop unit 36 mounted therein in a projecting manner. The stop unit 36 comprises an adjustable first stop surface 361 and an adjustable second stop surface 362, which correspond to the predetermined included angle a between the first stop section 15 and the second stop section 16, whereby the first stop section 15 and the second stop section 16 are respectively engageable with the first stop surface 361 and the second stop surface 362.

The first stop surface 361 and the second stop surface 362 are each provided with and fixed to a first stop element 3611 and a second stop element 3621, whereby the first and second stop elements 3611, 3621 are respectively engageable with the first stop section 15 and the second stop section 16, so that when the main body 10 is rotated, clockwise or counterclockwise, the first and second stop elements 3611, 3621 may selectively contact and engage the first stop section 15 and the second stop section 16 to stop further rotation of the main body 10.

The first stop element 3611 and the second stop element 3621 each have an end to which a cushioning pad D made of a rubber material is attached in order to reduce noise and absorb shocks and vibrations when the first and second stop elements 3611, 3621 are brought into contact with the first and second stop sections 15, 16.

The manual actuator 40 comprises a pressing section 41, a second fixing section 42, and a driving section 43. The second fixing section 42 is formed with at least two ball bearings and is thus rotatably mounted to the first fixing section 25. The driving section 43 is a flexible part that may adjust the tension, and is coupled to the projecting axle 14.

Figure 6:
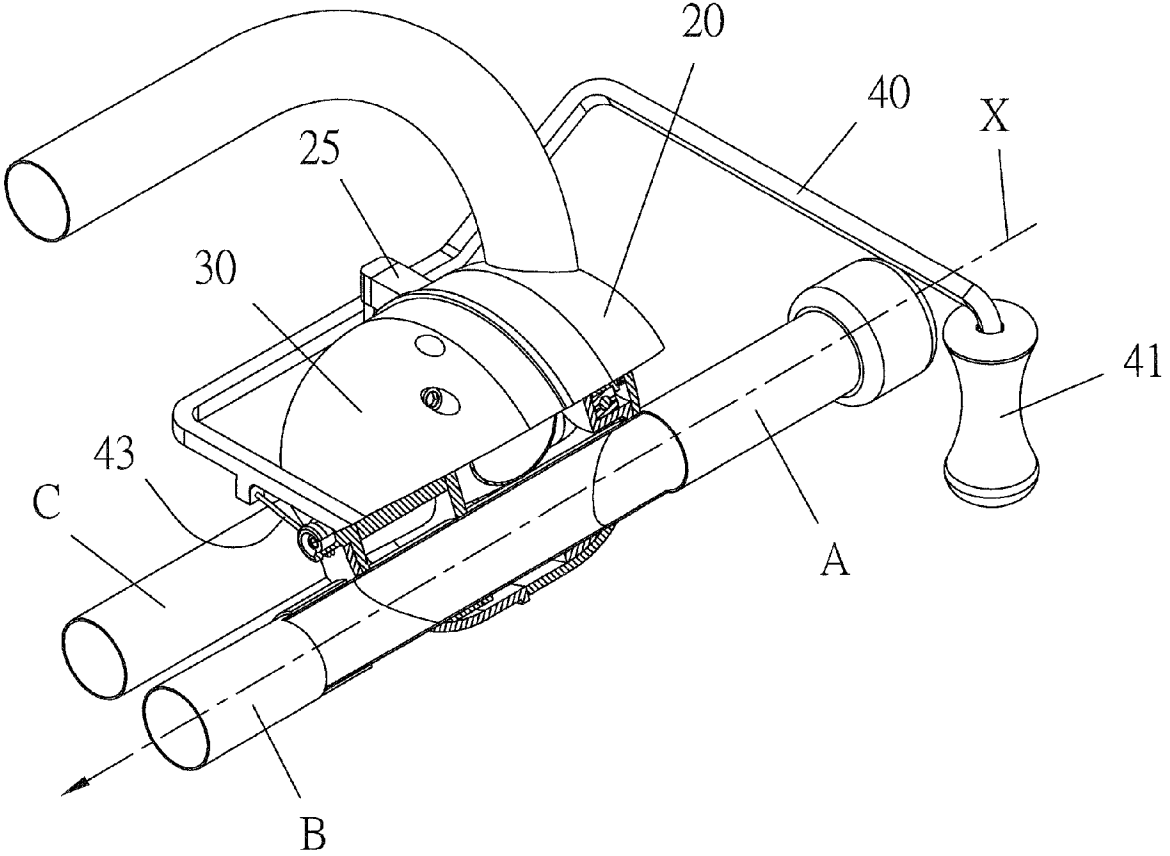
FIG. 6 is a perspective view showing the streamlined rotary valve according to the present invention in an operation condition where a manual actuator is not pressed down.
Figure 7:
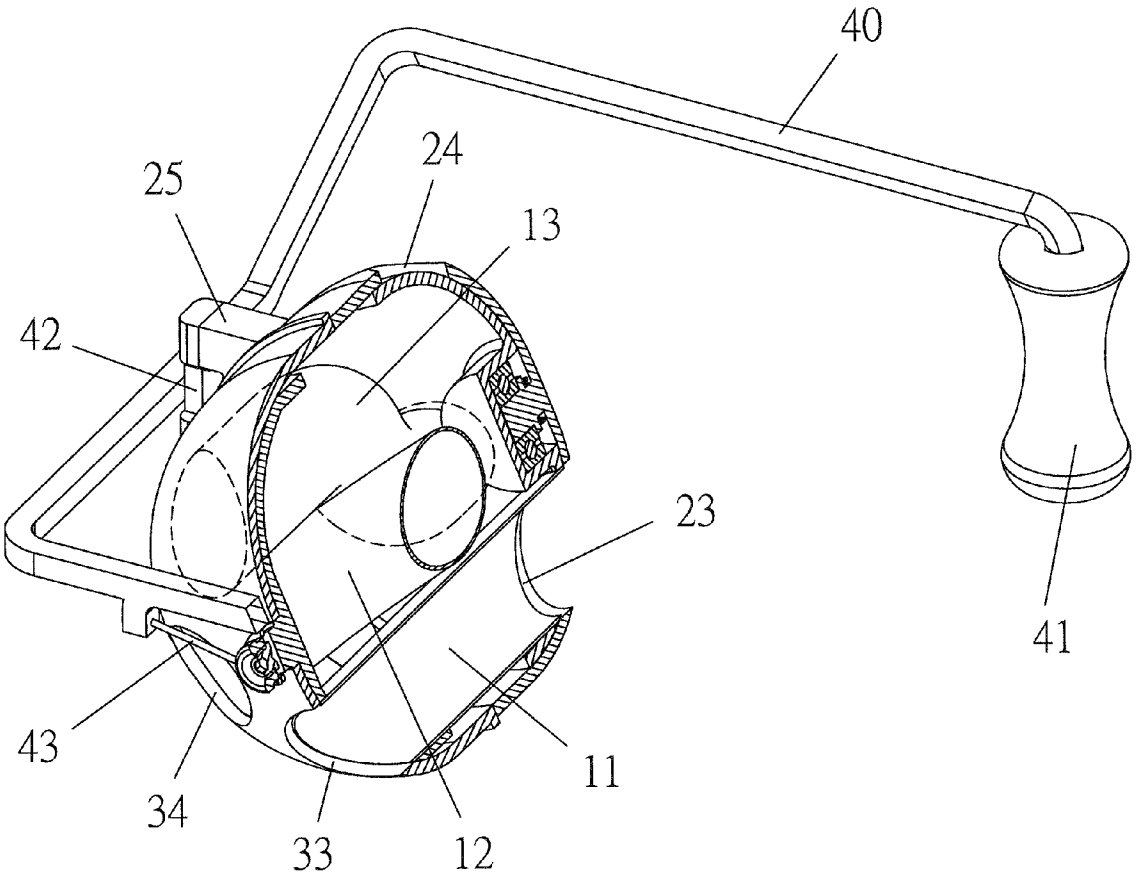
FIG. 7 is a partial perspective view, in a sectioned form, of FIG. 6.
Figure 8:
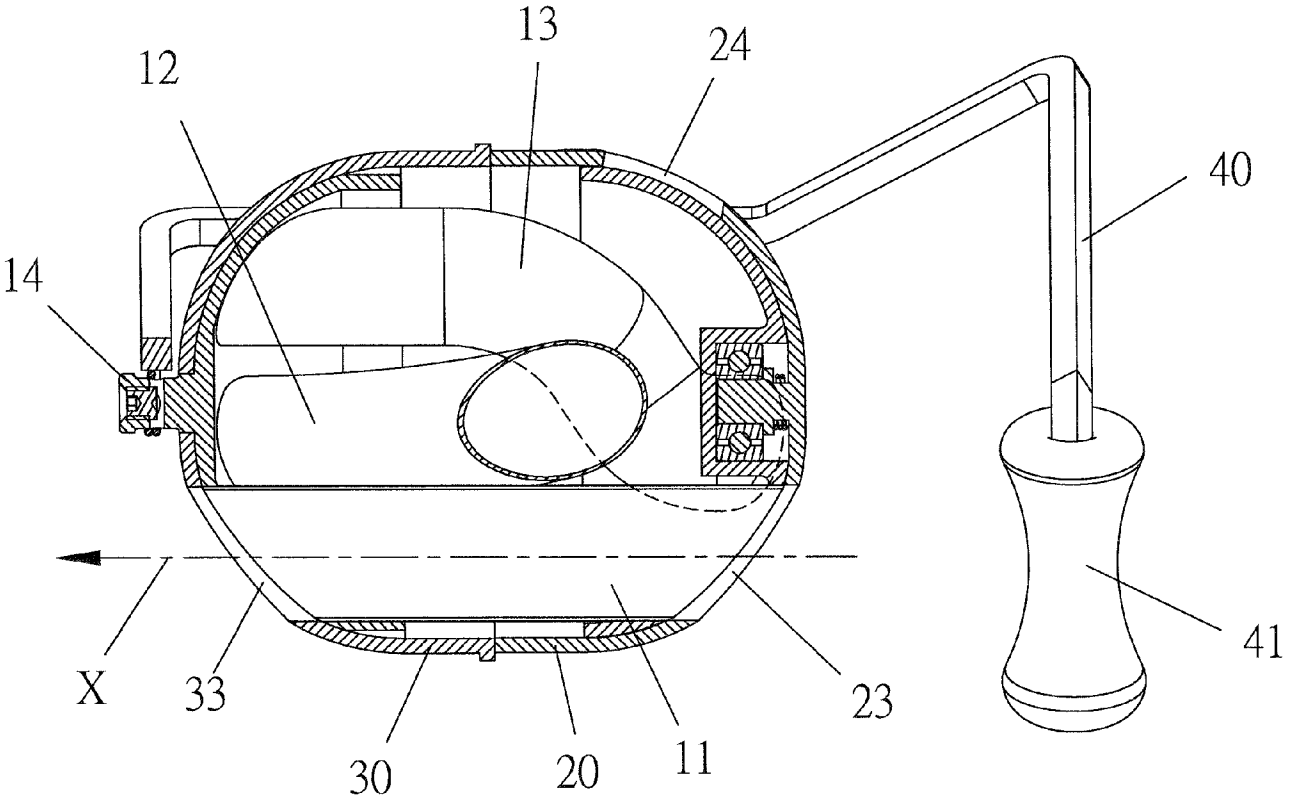
FIG. 8 is a cross-sectional view of FIG. 7 taken along an axial direction.

Referring to FIGS. 5-8, the streamlined rotary valve according to the present invention is shown in an operation condition where the pressing section is not pressed down. FIGS. 6 and 8 show a phantom line arrow to indicate airflow X when a user blows air. Since the manual actuator 40 is not engaged, the main slide unit A is set in communication with the first air inlet opening 23 of the first casing member 20, the first tube 11 of the main body 10, the first air outlet opening 33 of the second casing member 30, and the bell unit B, whereby airflow X is allowed to move directly through the streamlined rotary valve 1 and discharged via the bell unit B.

Figure 9:
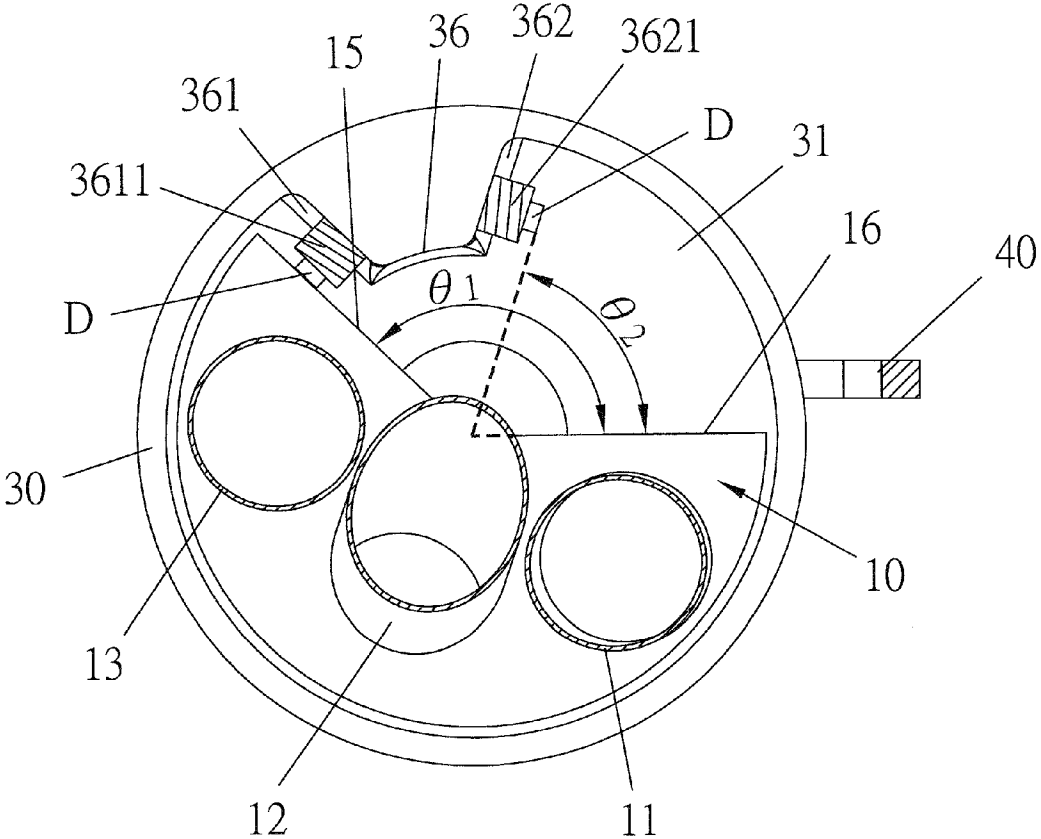
FIG. 9 is a cross-sectional view of FIG. 10 taken along a radial direction.
Figure 10:
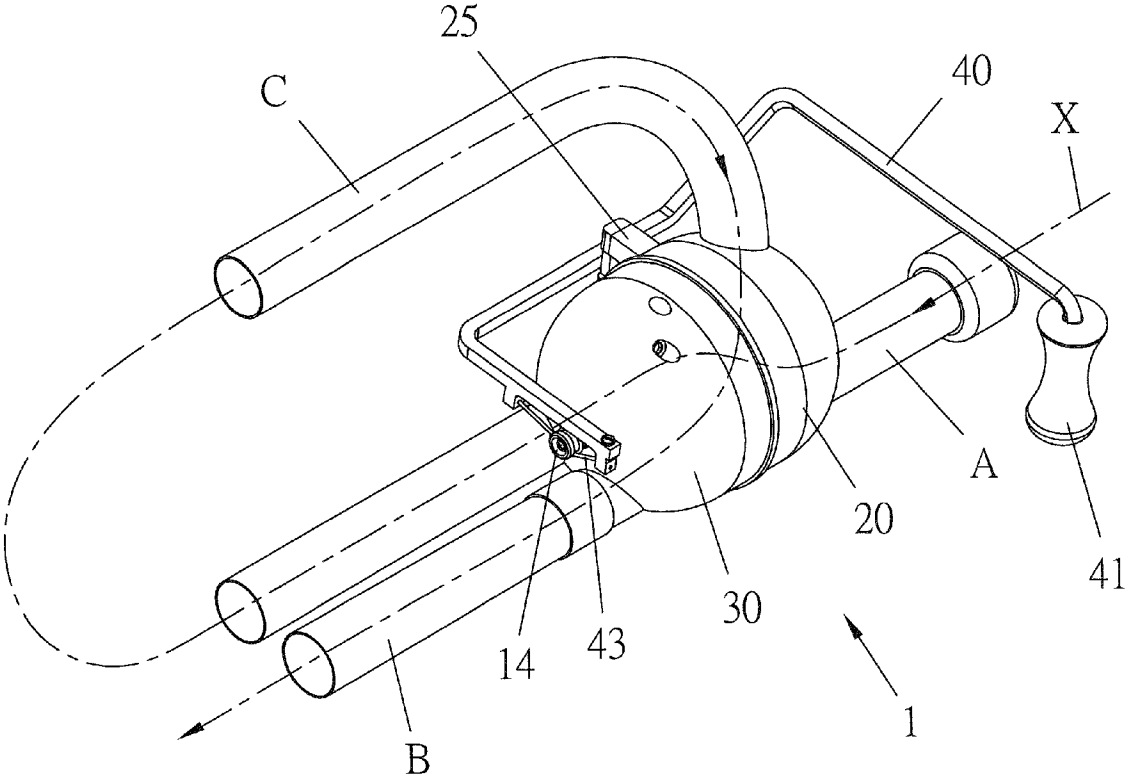
FIG. 10 is a perspective view showing the streamlined rotary valve according to the present invention in an operation condition where a manual actuator is pressed down.
Figure 11:
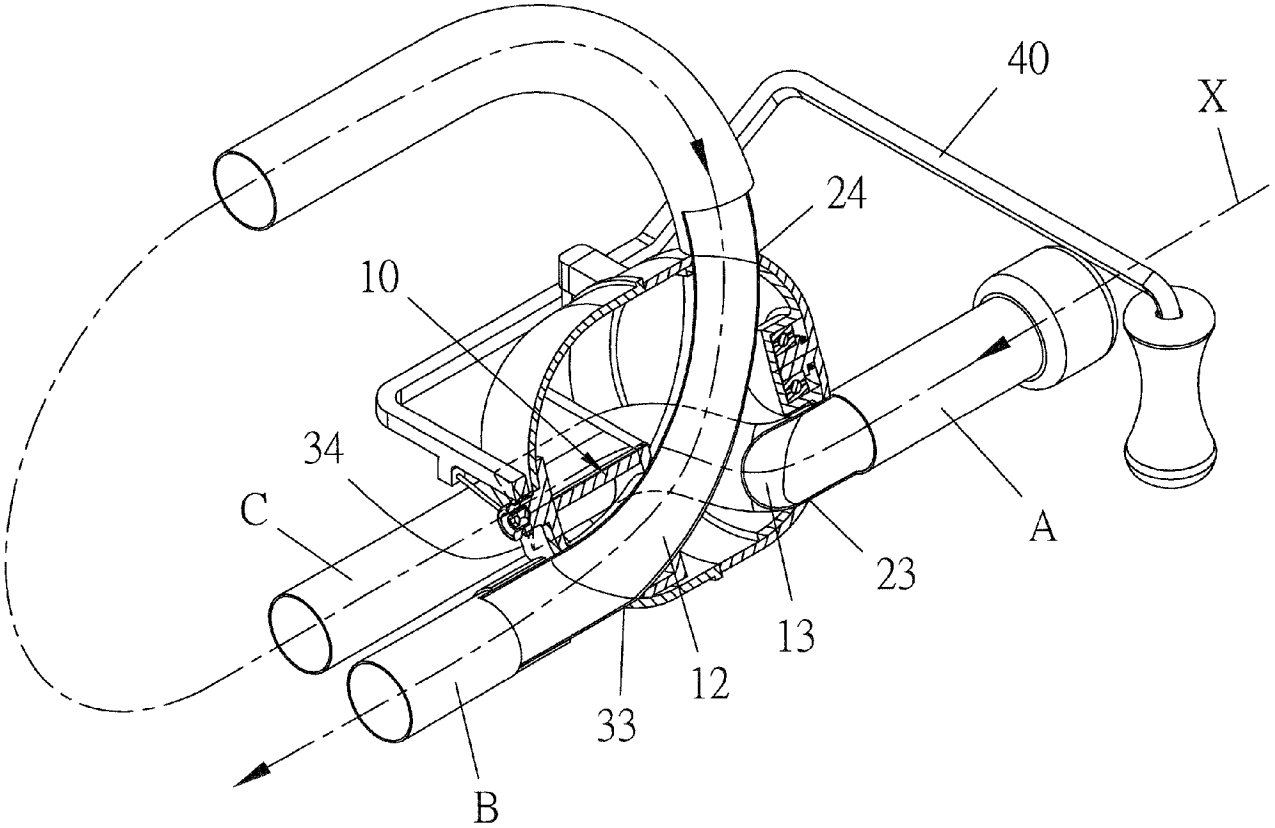
FIG. 11 is a perspective view, in a sectioned form, of FIG. 10.
Figure 12:
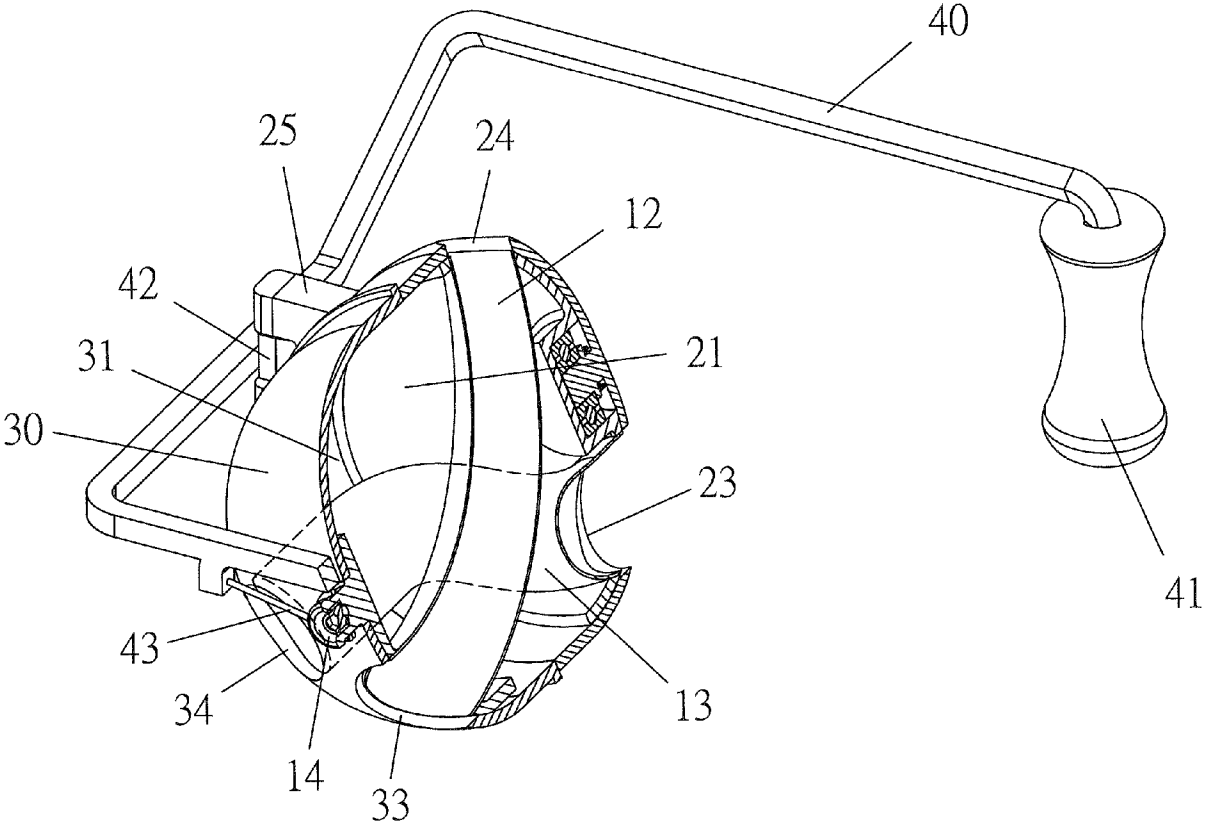
FIG. 12 is a partial perspective view, in a sectioned form, of FIG. 10.
Figure 13:
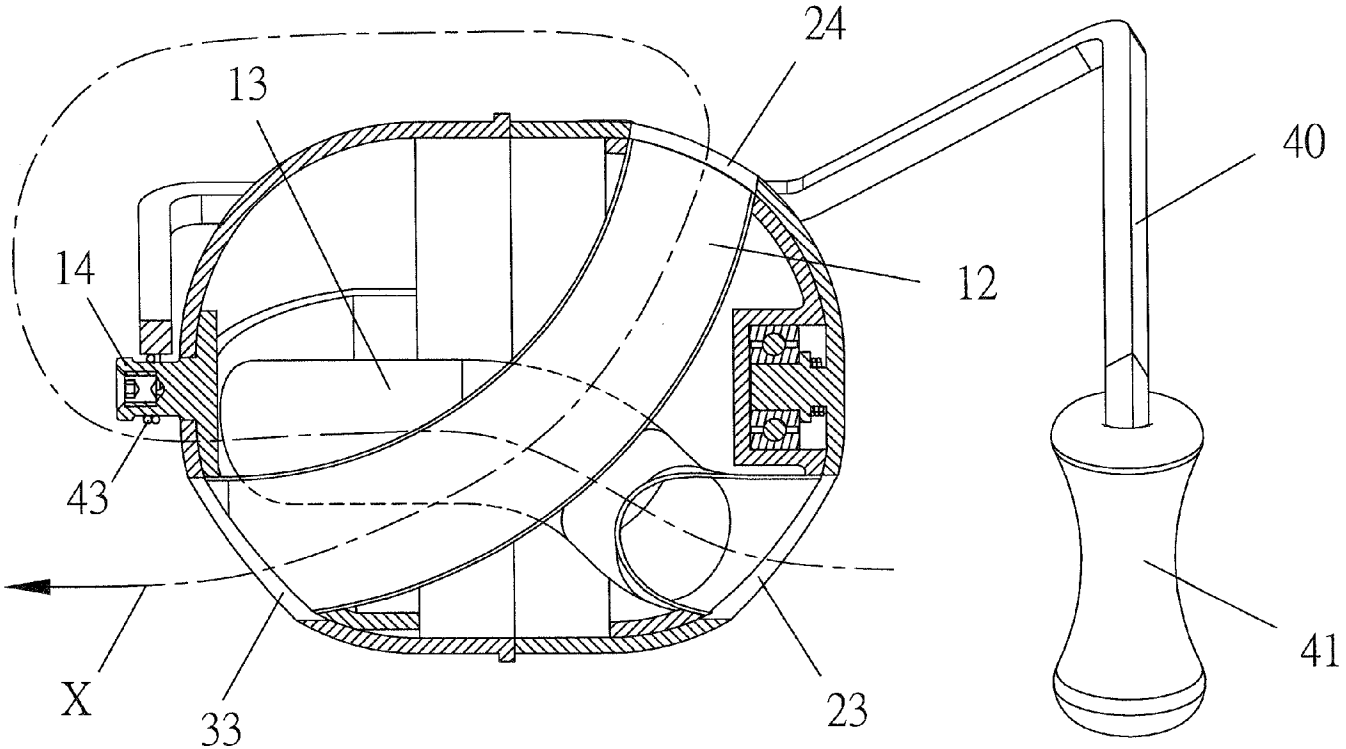
FIG. 13 is a cross-sectional view of FIG. 12 taken along an axial direction.

Referring to FIGS. 9-13, the streamlined rotary valve 1 according to the present invention is shown in an operation condition where the manual actuator 40 is engaged. FIGS. 10, 11 and 13 show a phantom line arrow indicating airflow X when a user blows air.

When the pressing section 41 is pressed down by an external force, the driving section 43 drives the projecting axle 14 of the main body 10 to rotate, so as to set the first stop section 15 of the main body 10 in engagement with the first stop element 3611 of the stop unit 36.

After the rotation of the main body 10, an end of the third tube 13 is brought into communication with the first air inlet opening 23 and an opposite end of the third tube 13 is in communication with the second air outlet opening 34. An end of the second tube 12 communicates with the second air inlet opening 24 and an opposite end of the second tube 12 is in communication with the first air outlet opening 33.

Thus, when a user blows and plays the instrument, the airflow X enters, via the main slide unit A, into the third tube 13, passing through the tuning slide unit C, and then returning via the second air inlet opening 24 back into the main body 10. Under the condition, an end of the second tube 12 of the main body 10 is in communication with the second air inlet opening 24, so that the airflow X moves through the second tube 12 and discharges via the bell unit B thereby generating a sound that is different from that caused when the manual actuator 40 is not engaged.

Referring to FIG. 9, when the first stop element 3611 engages the first stop section 15, the second stop element 3621 and the second stop section 16 form a second predetermined included angle θ2 therebetween. The second predetermined included angle θ2 is 72°. Reversely, referring to FIG. 5, when the second stop element 3621 is brought into engagement with the second stop section 16, the first stop element 3611 and the first stop section 15 form a second predetermined included angle θ2 therebetween and the second predetermined included angle θ2 is also 72°.

Figure 14:
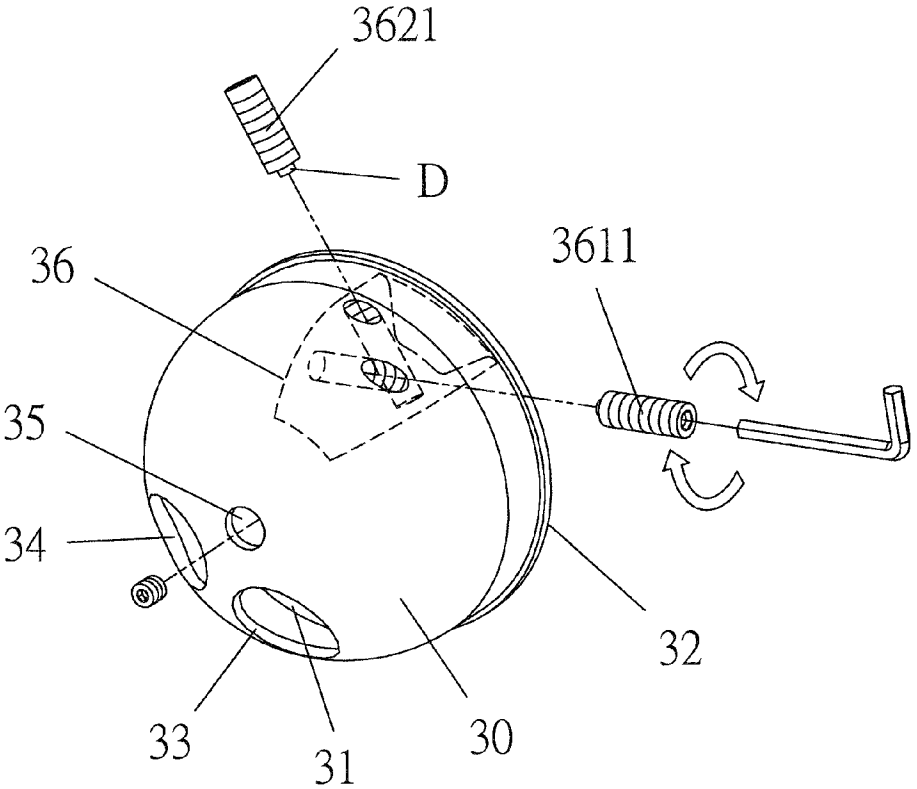
FIG. 14 is a schematic view illustrating minute adjustment of stop elements of the streamlined rotary valve according to the present invention.

Referring to FIG. 14, the first stop element 3611 and the second stop element 3621 can be minutely adjusted as desired to achieve the above-discussed second predetermined included angle θ2.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A streamlined rotary valve, comprising:

a main body, which comprises a first tube extending through the main body, a second tube extending through the main body, and a third tube extending through the main body, the main body having a top on which a projecting axle is formed;

a first casing member, which comprises a first accommodation space, a first opening, a first air inlet opening, a second air inlet opening, a first fixing section, and a pivot shaft, wherein the first opening, the first air inlet opening, the second air inlet opening, the first fixing section, and the pivot shaft are respectively provided at predetermined locations on the first casing member, whereby the pivot shaft is rotatably coupled to the main body and the first opening, the first air inlet opening, and the second air inlet opening are respectively in communication with the first accommodation space, the first air inlet opening being connected to an end of the first tube;

a second casing member, which comprises a second accommodation space, a second opening, a first air outlet opening, a second air outlet opening, and a shaft hole, wherein the second accommodation space, the second opening, the first air outlet opening, the second air outlet opening, and the shaft hole are respectively provided at predetermined locations on the second casing member and are each in communication with the second accommodation space, the first opening corresponding to and being coupled to the second opening so as to have the first accommodation space and the second accommodation space jointed to and communicating with each other to accommodate the main body therebetween, the first tube having an end that is opposite to the end connected to the first air inlet opening and is connected to the first air outlet opening, the projecting axle being received through the shaft hole; and a manual actuator, which comprises a pressing section, a second fixing section, and a driving section, the second fixing section being rotatably mounted to the first fixing section, the driving section being coupled to the projecting axle, wherein when the pressing section is pressed down by an external force, the driving section driving the projecting axle of the main body to rotate to have an end of the third tube communicating with the first air inlet opening, an opposite end of the third tube communicating with the second air outlet opening, an end of the second tube communicating with the second air inlet opening, and an opposite end of the second tube communicating with the first air outlet opening.

2. The streamlined rotary valve according to claim 1, wherein the first tube is located eccentrically to a portion of the main body.

3. The streamlined rotary valve according to claim 1, wherein the main body comprises, on one side thereof, a first stop section and a second stop section, the first stop section and the second stop section collectively define a first predetermined included angle therebetween about a center defined by the projecting axle, the second accommodation space comprising therein a stop unit, the stop unit having a first stop surface and a second stop surface, the first stop section and the second stop section respectively corresponding to the first stop surface and the second stop surface.

4. The streamlined rotary valve according to claim 3, wherein the first stop surface and the second stop surface are respectively provided with an adjustable first stop element and an adjustable second stop element, the first and second stop elements being respectively engageable with the first and second stop sections, whereby when the first stop element is in engagement with the first stop section, the second stop element and the second stop section form a second predetermined included angle, which is 72 degrees, and when the second stop element is in engagement with the second stop section, the first stop element and the first stop section form a second predetermined included angle, which is 72 degrees.

5. The streamlined rotary valve according to claim 4, wherein the first and second stop elements each have an end to which a cushioning pad made of a rubber material is attached.

6. The streamlined rotary valve according to claim 1, wherein the pivot shaft is provided at an inside bottom of the first accommodation space and the pivot shaft is provided with and encompassed by an elastic element and a bearing, the pivot shaft being rotatably coupled to a bottom of the main body.

7. The streamlined rotary valve according to claim 6, wherein the bearing is a sealed ball bearing.

8. The streamlined rotary valve according to claim 1, wherein the first air inlet opening of the first casing member is connected, at an outside thereof, to a main slide unit or to another rotary valve.

9. The streamlined rotary valve according to claim 1, wherein the first air outlet opening of the second casing member is connected, at an outside thereof, to a bell unit or to another rotary valve.

10. The streamlined rotary valve according to claim 1, wherein the second air inlet opening of the first casing member and the second air outlet opening of the second casing member are connected, at an outside thereof, to a tuning slide unit or to another valve.

11. The streamlined rotary valve according to claim 1, wherein a manual actuator, which comprises a pressing section, a second fixing section, and a driving section; the second fixing section being rotatably mounted to the first fixing section by two ball bearings or more.

12. The streamlined rotary valve according to claim 1, wherein a manual actuator, which comprises a pressing section, a second fixing section, and a driving section; the driving section is represented by a string supported by a bracket that can be adjusted to the desired tension.

13. The streamlined rotary valve according to claim 3, wherein the first stop surface and the second stop surface are respectively provided inside the second casing member; including an adjustable first stop element and an adjustable second stop element.

* * * * *